United States Patent [19]

Ohtani

[11] Patent Number: 4,772,147

[45] Date of Patent: Sep. 20, 1988

[54] PRINTER APPARATUS

[75] Inventor: Shigeru Ohtani, Kawasaki, Japan

[73] Assignee: Mitutoyo Mfg. Co., Ltd., Tokyo, Japan

[21] Appl. No.: 927,288

[22] Filed: Nov. 4, 1986

[30] Foreign Application Priority Data

| | | | |
|---|---|---|---|
| Nov. 8, 1985 | [JP] | Japan | 60-251132 |
| Nov. 12, 1985 | [JP] | Japan | 60-253550 |
| Nov. 12, 1985 | [JP] | Japan | 60-253551 |

[51] Int. Cl.[4] ..... B41J 15/04; B41J 29/08

[52] U.S. Cl. ..... 400/690.1; 400/693; 400/613

[58] Field of Search ..... 400/690, 690.1, 691, 400/693, 613, 613.1, 614, 690.2, 615.1; 346/136; 242/67.1 R, 67.3 R

[56] References Cited

U.S. PATENT DOCUMENTS

| | | | |
|---|---|---|---|
| 1,646,936 | 10/1927 | Smith | 400/615.1 |
| 1,659,553 | 2/1928 | Rowley | 400/690.2 |
| 2,268,018 | 12/1941 | Close | 400/615.1 |
| 3,294,212 | 12/1966 | Gearheart et al. | 400/613 |
| 3,901,372 | 8/1975 | Denley | 400/690.1 |
| 4,166,588 | 9/1979 | Krehbiel et al. | 242/67.1 R |
| 4,207,131 | 6/1980 | Hamisch, Jr. | 101/288 |
| 4,209,139 | 6/1980 | Alper | 242/67.3 R |
| 4,218,013 | 8/1980 | Camier et al. | 242/67.3 R |
| 4,264,396 | 4/1981 | Stewart | 101/288 |
| 4,526,489 | 7/1985 | Tsumuraya et al. | 400/693 |

FOREIGN PATENT DOCUMENTS

| | | | |
|---|---|---|---|
| 152981 | 9/1982 | Japan | 400/613 |
| 24489 | 2/1983 | Japan | 400/613 |
| 1294145 | 10/1972 | United Kingdom | 400/613 |

OTHER PUBLICATIONS

Brown et al., "Improved Illumination . . . " IBM Technical Disclosure Bulletin vol. 24, No. 10, p. 5235, 3–82.

Meister Jr., "Acoustic Cover" IBM Technical Disclosure Bulletin vol. 24, No. 8, p. 4101, 1–82.

*Primary Examiner*—Pieprz, William

*Attorney, Agent, or Firm*—Flynn, Thiel, Boutell & Tanis

[57] ABSTRACT

A printer apparatus suitable for use in measuring systems and control systems. The printer apparatus has a casing accommodating a roll of a recording paper sheet and a cover means for covering and protecting the recording paper sheet after the printing. The cover means is shaped such as to follow the curvature of the upper portion of the roll of the recording paper sheet, and the recording paper sheet after the printing is guided along the curvature of the roll and is stored in the cover means in the form of a scroll.

11 Claims, 4 Drawing Sheets

PRINTER APPARATUS

BACKGROUND OF THE INVENTION

1. Field of the Invention

The present invention relates to a printer which can print characters and other data in accordance with input signals and, more particularly, to a printer which is suitable for use in measuring or controlling purposes and capable of ensuring high quality of recording by printing even in an atmosphere which is rich in contaminants such as water, oil, dust and so forth, while facilitating the management of the record.

2. Description of the Prior Art

In recent years, a rapid progress has been made in the fields of electrical measurement and control. The measurement or control by electrical means usually requires, for the purpose of recording the results of measurement or the procedure of the control operation, a printer which is capable of printing characters or other data on a sheet of recording paper in accordance with input signals. The use of such a printer contributes to improvement in the efficiency of the measuring or control operation, and enables such an operation to be conducted in a rational way.

For instance, Japanese Patent Publication No. 33574/1984 of the same applicant discloses a measuring system which incorporates a printer as a recording means together with a digital display device, so that the measured data is recorded by the printer. This conveniently eliminates the necessity of manually transcribing the displayed data to, for example, a data sheet, so that the efficiency of the work is remarkably improved.

This known printer, however, suffers from the following disadvantages. Namely, this type of printer usually does not have any means for suitably guiding or directing the data sheet coming out of the printer after the recording, nor means for positively packing or stacking the same. It is, therefore, often experienced that the data sheet after the recording, which usually has an upward curving or buckling tendency, is turned upside down to hinder the visual check of the recorded data.

In some cases, a long data sheet after recording, which has been continuously discharged from the printer, is folded and tangled in a random manner or falls onto the floor, with the result that the data sheet is contaminated or damaged through contact with other devices. In addition, the user often encounters a problem in moving the printer, owing to difficulty in handling of the long data sheet after recording.

In order to overcome this problem, it has been proposed to cut the data sheet coming out of the printer in a suitable length. This countermeasure, however, suffers from various problems. For instance, the sequence of successive cut sheets of record, which carry a group of voluminous data, may be disordered or one of more cut sheets may be lost, so that the operator is obliged to take a labor for putting the sheets in order or finding the lost sheets. It is of course possible to put the sheets in order and to stack them by manual labor. This, however, requires a suspension of the measuring work, thus impairing the advantage offered by the printer. In addition, the manual work tends to cause the data sheets to be contaminated by water or oil which may have attached to the operator's hand..

In general, a printer has a cover which is provided with slits or similar openings such as that for discharging the data sheet after the recording. Thus, the interior of the printer tends to be damaged or contaminated by water, oil or dust which may be introduced into the printer through these openings, particularly in the case where the printer is used in an environment rich in such contaminants. In such a case, needless to say, there is a risk that the data sheet after the recording, which has been discharged out of the printer, is contaminated or broken. This has given a rise to a demand for a protective measure for protecting the interior of the printer and the data sheet before and after the printing, against any contaminant such as water, oil or dust which may exist around the printer.

SUMMARY OF THE INVENTION

Accordingly, an object of the present invention is to provide a printer which enables an easy visual check of the data recorded on the data sheet and which effectively protects the data sheet and the internal structure of the printer against environmental contaminants such as water, oil and dust, while storing the sheet after recording in the form of roll or scroll.

To this end, according to the invention, a printer in accordance with the present invention has a casing for rotatably supporting a roll of a recording paper sheet, and a cover means mounted on the casing and adapted for protecting the recording paper sheet in the casing. The casing is arranged such that the leading end of the recording paper sheet is projected and guided upward. In addition, the casing is provided with an outlet slit through which the recording paper sheet after the recording is discharged. The paper sheet after the recording, which has been discharged through the outlet slit, is advanced along the curvature of the roll of the recording paper sheet. The inner surface of the cover means has such a configuration as to smoothly guide the leading end of the recording paper sheet and to generate a natural tendency for the paper sheet to form a scroll.

The above and other objects, features and advantages of the invention will become clear from the following description of the preferred embodiment when the same is read in conjunction with the accompanying drawings.

DESCRIPTION OF THE PREFERRED EMBODIMENT

Figure 1:
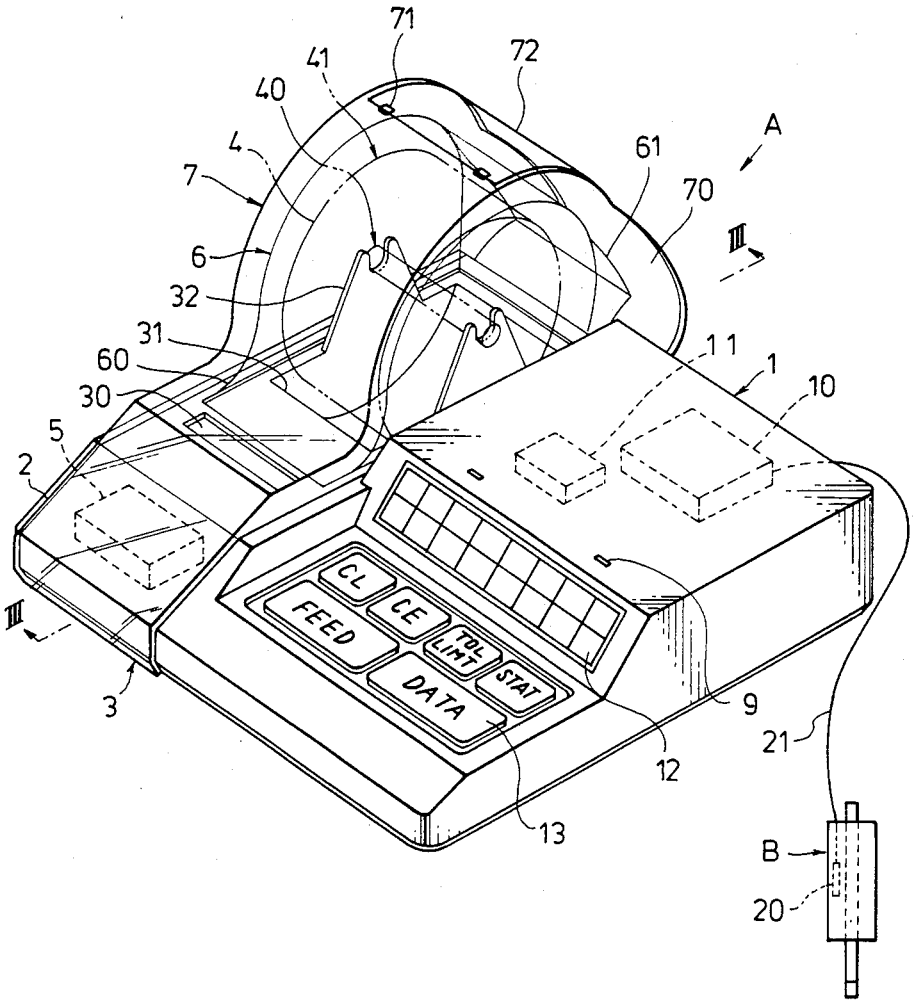
FIG. 1 is a perspective view of an embodiment of the present invention.
Figure 2:
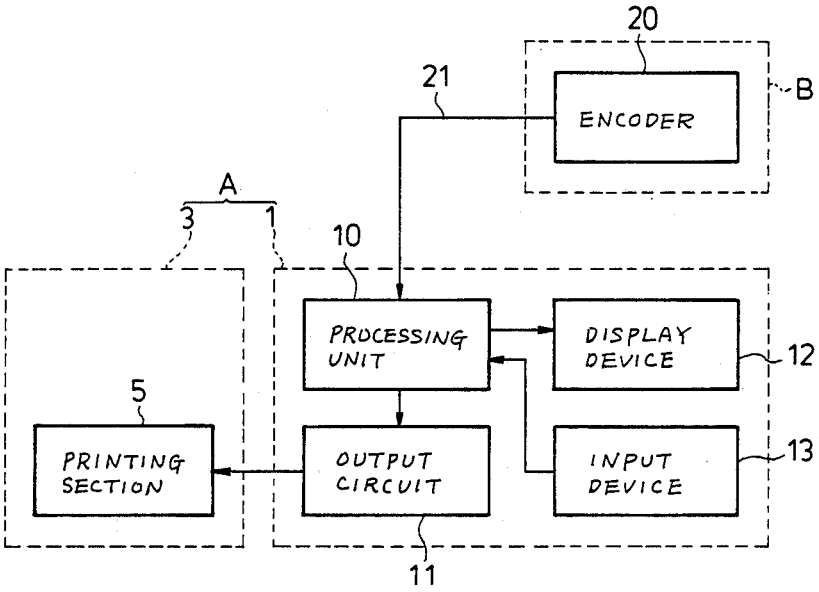
FIG. 2 is a block diagram of a circuit incorporated in the embodiment shown in FIG. 1.
Figure 3:
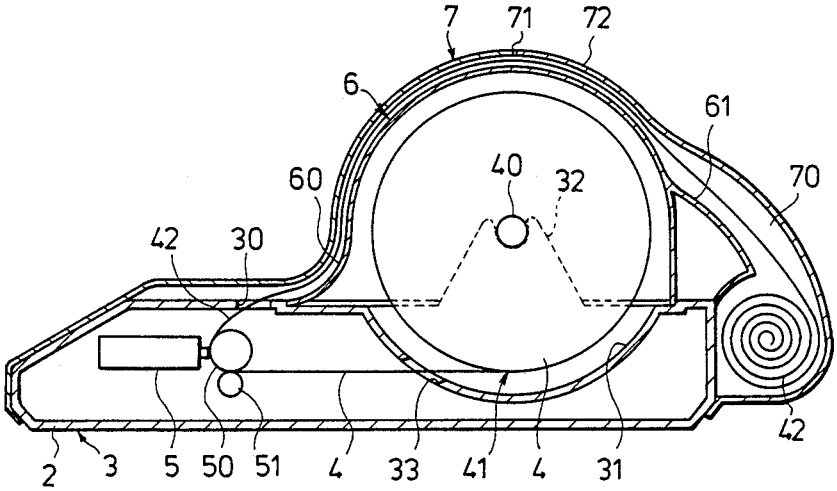
FIG. 3 is a sectional side elevational view of the embodiment taken along the line III—III of FIG. 1.

FIGS. 1 to 3 show a first embodiment of the printer in accordance with the present invention which is applied to a measuring system.

The printer, which is generally represented by A, has a processing unit 1 which is designed to conduct a predetermined processing of input signals delivered by an external device such as a measuring device B so as to produce signals representing the measured values, and a printing unit 3 which prints characters or data corresponding to the signals produced by the processing unit 1. The processing unit 1 has a processing circuit 10 which processes electric signals from the measuring device B so as to produce signals corresponding to the measured values, and an output circuit 11 through which the signals corresponding to the measured values are outputted to the printing device 3 thus enabling the printer to print the measured data.

The processing unit 1 is provided on the upper surface thereof with indicators 9 constituted by suitable light-emitting elements such as LEDs or neon tubes. The indicators are adapted to be turned on and off to provide signs representing the states of the printer such as errors, e.g., an internal error or paper exhaustion, ready or not ready for operation, state of the power supply, and so forth. The processing unit 1 also is provided on the upper surface thereof with an electronic display device of dot-matrix type of 7-segment type employing liquid crystal or LEDs, capable of displaying desired characters and numerals. The processing unit 1 further has an input device 13 incorporating a flat keyboard such as of sheet switch type. The display device 12 is capable of displaying, in accordance with signals inputted through suitable operations of the input device 13, various data such as the measured values derived from the measuring device B, as well as status and error information which informs the operator of the status of the measuring device B or any error occurring in the measuring device B.

The measuring device B is an electronic measuring device such as of electronic dial meter incorporating an encoder 20. The measuring device B is capable of converting the measured values into electric signals which are then transmitted to the processing circuit 10 in the processing unit 1 through the cable 21.

The printing unit 3 has a casing 2, and is constructed as a unit with the processing unit 1. The printing unit 3 has a printing section 5 mounted therein. The printing section 5 is connected to the output circuit 11 and is capable of printing data on the recording paper sheet 4. The upper panel of the casing 2 has a substantially semi-cylindrical roll-receiving recess 31 in which is formed a paper inlet slit 33. The top panel of the casing 2 is also provided with a paper outlet slit 30 through which the recording paper sheet after printing is discharged. A pair of opposing roll supports 32 are provided on both sides of the casing 2 at portions thereof defining the roll-receiving recess 31.

The recording paper sheet 4 is stored in the form of a roll 41 on a core 40. The core 40 is rotatably supported at its both axial ends by the roll supports 32 in such a manner that the lower end portion of the roll 41 is received in the roll-receiving recess 31 and that the center of the core 40 is disposed at a level above the printing unit 3. The arrangement is such that the recording paper sheet 4 unrolled from the roll 41 is led to the printing section 5 in the casing 2 through the paper inlet slit 33.

The printing section 5 is together with a platen 50 within the casing 2, and is adapted for conducting a suitable processing of the signals delivered from the processing circuit 10 through the output circuit 11 and for printing characters and other data on the recording paper sheet 4 in accordance with the thus processed signals. The printing section also has a paper feed roller 51 which is adapted to operate in cooperation with the platen 50 by power of a suitable driving means such as an electric motor (not shown). The paper feed roller 51 functions such as to continuously feed the recording paper sheet 4 out of the printing section 5 after the printing of the data thereon, so that the recording paper sheet 4 is progressively discharged to the outside of the printer through the paper outlet slit 30.

On the upper side of the casing 2, provided is a first cover member 6 which is suitably curved to follow the upper curvature of the roll 41 of the recording paper sheet 4 so as to cover the roll 41, and a second cover member 7 which covers the first cover member 6 and the paper outlet slit 30 formed in the top panel of the casing 2. In the illustrated embodiment, the first cover member 6 and the second cover member 7 in combination constitute a cover means which provides an essential feature of the present invention.

The first cover member 6 is made of a transparent material and is detachably secured to the casing 2. The first cover member 6 has a configuration which follows the curvature of the upper portion of the roll 41 of the recording paper sheet 4. More specifically, the first cover member 6 has an arcuate paper guide section 60 which starts from a position on the upper surface of the casing 2 near the paper outlet slit 30 and extends in the circumferential direction of the roll 41 along the curvature thereof, and a storage guide section 61 which extends from the end of the arcuate guide section 60 away from the roll 41 of the paper sheet at the opposite side of the roll 41 to the paper outlet slit 30.

The second cover member 7 also is made of a transparent material, and is detachably secured to the printing unit 3, so as to cover the first cover member leaving a suitable gap therebetween. The portion of the second cover member 7 which covers the storage guide section 61 of the first cover member 6 is expanded outward, i.e., away from the first cover member 6, so that a storage space 70 is formed between the first cover member 6 and the second cover member 7. This storage space 7 is large enough to store a predetermined amount or length of the recording paper sheet which has been discharged through the paper outlet slit 30 and forwarded through the space between the first cover member 6 and the second cover member 7. The second cover member 7 is provided at its top portion with a hinge 71 through which the portion of the second cover member 7 covering the storage space 70 is hinged to the remainder portion of the second cover member 7. Thus, the portion of the second cover member covering the storage space 70 constitutes a hinged door 72 which can be opened to make the recording paper sheet 42 stored in the storage space 70 accessible, so that the user can take out the recording paper sheet 42 when necessary.

The operation of the described embodiment of the present invention is as follows.

The measuring device B produces electric signals corresponding to the measured values and sends these signals to the processing device 10. The thus obtained signals representing the measured values are suitably processed so that the measured values are displayed as required on the display device 12 in accordance with the instruction given through the input device 13. The signals representing the measured values are also delivered as required to the printing section 5 through the output circuit which is not shown. The printing section 5 then suitably processes these signals and print the data corresponding to these signals on the recording paper sheet 4.

During the printing, the recording paper sheet 4 is successively unrolled from the roll 41 and fed into the printing section 5 through the paper inlet slit 33, by the action of the platen 50 and the paper feed roller 51, and the portion of the recording paper sheet on which the data has been printed is discharged through the paper outlet slit 30 into the passage provided by the gap between the first cover member 6 and the second cover member 7. As the recording paper sheet is further fed, the leading end of the printing paper sheet 42 advances along the passage defined by the arcuate guide section 61 of the first cover member 6 and the corresponding portion of the second cover member 7 and is smoothly guided into the storage space 70. It will be understood that the recording paper sheet 42 is naturally coiled into the form of a scroll as it is guided by the storage guide section 61 of the first cover member 6. The scroll of the recording paper sheet thus obtained is usually stored in the storage space 70 so that it is kept away by the second cover member 7 from external contaminants, although it is accessible through opening of the door section 72 of the second cover member 7. It will be seen the recording paper sheet 4 and the roll 41 of the same, as well as the paper inlet slit 33, are protected by the first cover member 6 from external contaminants or damaging force, while the paper outlet slit 30 and recording paper sheet 42 after the printing are protected similarly by the second cover member 7.

Thus, in the described embodiment of the present invention, the portion of the recording paper sheet in the roll 41 and the portions 4, 42 of the same before and after the printing are effectively protected by the first and the second cover members 6 and 7, so that contamination of the recording paper sheet by external contaminants such as water, oil and dust, as well as damaging by external force, is prevented advantageously. At the same time, both the paper inlet slit 33 and the paper outlet slit 30 are covered by the first and the second cover members 6 and 7, so that damaging of the internal parts of the printer due to invasion of water, oil, dust and so forth is avoided. In addition, since the portion 42 of the recording paper sheet after the printing is stored in a compact manner within the storage space 70, the printer can be handled and moved without difficulty. If necessary, the user can take out the recording paper sheet 42 in the storage space 70 at once by opening the door section 72 of the second cover member. The storage space 70 can store a predetermined amount or length of the recording paper sheet without requiring the sheet to be cut and without any risk of contamination or damaging of the sheet.

It will be seen also that the second cover 7 made of a transparent material enables the user to easily recognize the content of the data printed on the recording paper sheet 42 immediately after the printing. The transparency of the second cover member 7 also enables the user to visually check the amount of the paper stored in the storage space 70, so as to eliminate any risk of wrinkling or damaging of the recording paper sheet which may otherwise be caused by accommodation of a too large amount of recording paper sheet 42 after printing. In addition, the transparent nature of the first cover member 6 enables the user to visually check the amount of recording paper sheet in the roll 41, thus eliminating any risk of printing failure attributable to exhaustion of the paper.

Figure 4:
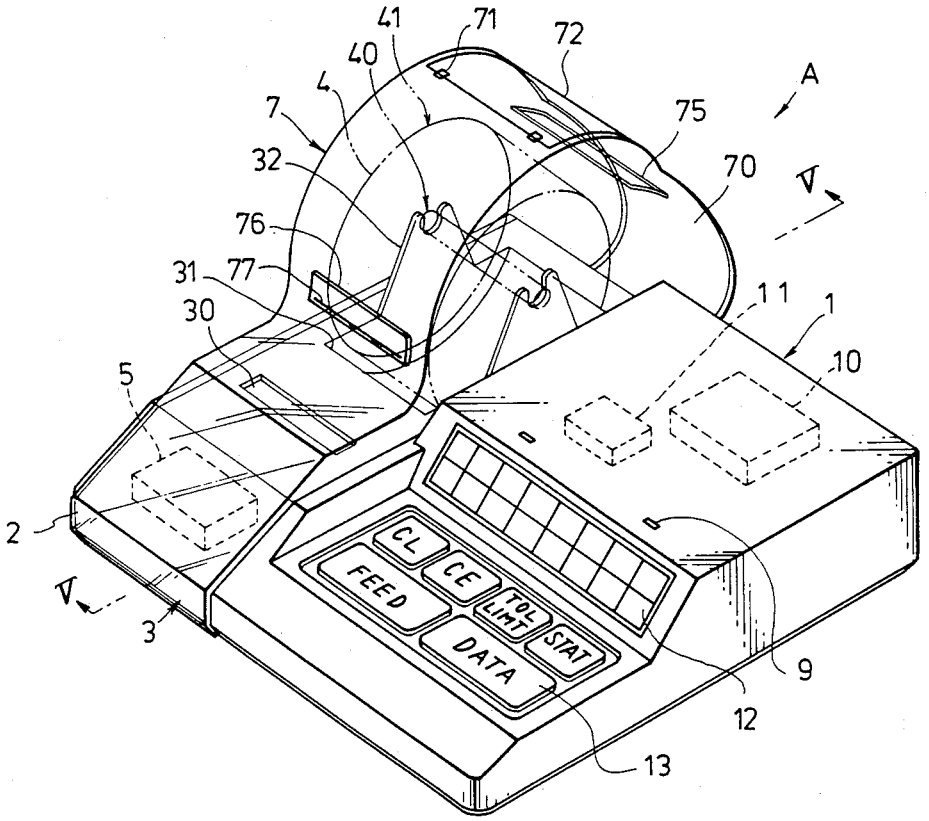
FIG. 4 is a perspective view of a modification of the embodiment shown in FIG. 1.
Figure 5:
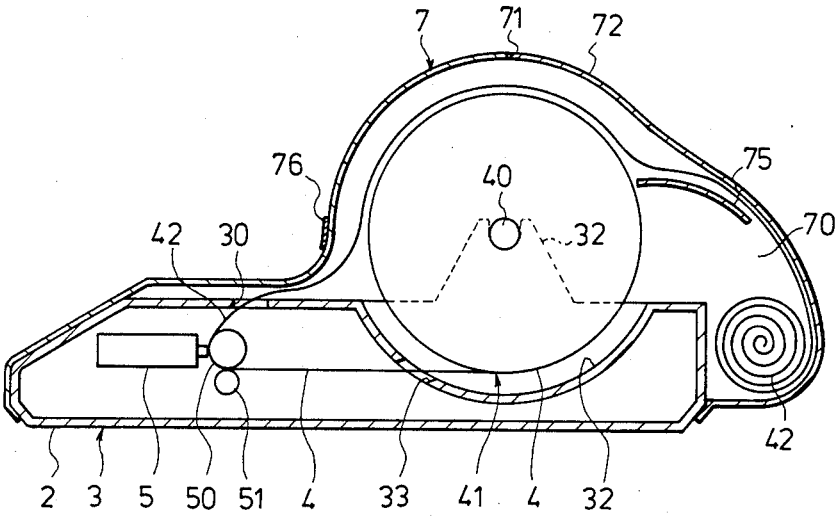
FIG. 5 is a sectional side elevational view of the modification taken along the line V—V in FIG. 4.

FIGS. 4 and 5 show a modification of the embodiment described in connection with FIGS. 1 to 3. In contrast to the embodiment in which the cover means has a double-walled structure constituted by the first and the second cover members 6 and 7, the modification shown in FIGS. 4 and 5 employs only the second cover member 7. Thus, in this modification, the recording paper sheet 4 before the printing and the recording paper sheet 42 after the printing is protected by the second cover member 7 solely. In addition, a foil-shaped guide member 75 is secured at its both ends to opposing walls of the second cover member 7 at an upper portion of the storage space 70. In operation, the recording paper sheet 42 after printing is moved along the path defined between the outer peripheral surface of the roll 41 and the inner surface of the second cover member 7 and is scrolled into the storage space 70 along the guide member 75. Thus, the modification shown in FIGS. 4 and 5 offer an advantage over the described embodiment in that the construction of the printer apparatus as a whole can be simplified, without substantially impairing the advantages of the present invention.

The second cover member 7 may be provided with a linear magnifier lens 76 and a scale line 77 as shown in FIG. 4, for an easier visual confirmation of the recorded data.

In the present invention, it is not essential that the first cover member 6 is made of a transparent material: namely, the first cover member 6 may be made of a translucent or opaque material, provided that a window is formed therein to enable the user to check the amount of the recording paper sheet on the core 40. The window may be omitted if the circumstance allows periodical check of the amount of the recording paper sheet on the core 40 and supply of the recording paper sheet by removal of the first cover member 6.

The guide section 60, which has an arcuate configuration in the described embodiment, may have other suitable forms which provide similar guiding effect. All that is required for the guide section 60 is that it can smoothly guide the recording paper sheet 42 from the paper outlet slit 30 towards the storage section along the curvature of the first cover member 6.

The provision of the door section 72 hinged through the hinge 71 is not essential, and may be omitted if a suitable means is provided for enabling the user to take out the scroll of the recording paper sheet 42 from the storage space 70 or if the circumstance allows to demount the second cover member 7 each time the second cover member 7 is to be taken out.

The storage guide section 61 of the first cover member 6 may be substituted by an equivalent means provided on the second cover member or may be eliminated if a somewhat random manner of storage of the sheet in the storage space 70 is permissible.

As will be fully understood from the foregoing description, the present invention offers various advantages such as easy recognition of the data printed on the recording paper sheet, protection of the recording paper sheet and the printer internal structure against external contaminants such as water, oil and dust, and easy accommodation of the recording paper sheet after the printing in the form of a scroll.

What is claimed is:

1. A printer apparatus comprising:

a casing having means for rotatably supporting thereon a source of recording paper such that said recording paper can be fed to a printing means, said casing having an inlet slit for admitting said recording paper and such a configuration that said recording paper, after passing said printing means, can project to a level above said casing and through a paper outlet slit to the exterior of said casing;

said printing means including a printing section and a feeding section provided in said casing said printing section adapted to print on said recording paper and said feeding section effecting a movement of said recording paper to and through said outlet slit; and cover means detachably secured to said casing, said cover means having a first cover member which covers said source of said recording paper, and a second cover member which covers said first cover member and said paper outlet slit such that a passageway is formed therebetween so as to smoothly guide said recording paper after said recording paper exits through said paper outlet slit, said cover means including further means for defining a storage space between said first and second cover members, said storage space being openly connected to said passageway to enable said storage space to store a predetermined amount of said recording paper after recording thereon.

2. A printer apparatus according to claim 1, wherein said recording paper is in the form of a roll on said casing such that the center of said roll is positioned at a level above said casing, said first cover member covering said roll.

3. A printer apparatus according to claim 1, wherein said cover means has a hinged door section for providing access to said storage space.

4. A printer apparatus according to claim 1, further comprising a guide means provided in said storage space so as to facilitate the scrolling of said recording paper in said storage space.

5. A printer apparatus according to claim 1, wherein said cover means is provided with at least one breadthwise scale line.

6. A printer apparatus according to claim 1, wherein said cover means is provided with at least one breadthwise magnifier lens.

7. A printer apparatus according to claim 1, wherein said second cover member is provided with a door section which enables said recording paper to be accessed.

8. A printer apparatus according to claim 1, wherein a portion of said first cover member adjacent to said storage space is provided with a guiding means for guiding said recording paper in such a manner as to facilitate scrolling of said recording paper in said storage space.

9. A printer apparatus according to claim 1, wherein said second cover member is provided with a breadthwise scale line and a breathwise magnifier lens formed as a unit with said scale line.

10. A printer apparatus according to claim 1, further comprising a processing device for processing inputs from an external device.

11. A printer apparatus according to claim 10, wherein a measuring device capable of producing signals representing measured values is connected to said processing device.

* * * * *